US006186224B1

(12) United States Patent
Seidel

(10) Patent No.: US 6,186,224 B1
(45) Date of Patent: Feb. 13, 2001

(54) HEAT EXCHANGER PLATES AND SEALING GASKETS THEREFOR

(76) Inventor: Pessach Seidel, 25 Ma'ale HaOren Street, Motza Ilit 90820 (IL)

( * ) Notice: Under 35 U.S.C. 154(b), the term of this patent shall be extended for 0 days.

(21) Appl. No.: 09/178,792

(22) Filed: Oct. 26, 1998

(30) Foreign Application Priority Data

Jun. 25, 1998 (IL) ..... 125113

(51) Int. Cl.[7] ..... F28F 3/10
(52) U.S. Cl. ..... 165/166; 165/167
(58) Field of Search ..... 165/166, 167; 277/314

(56) References Cited

U.S. PATENT DOCUMENTS

| | | | | |
|---|---|---|---|---|
| 3,195,625 | * | 7/1965 | Thomson | 165/166 |
| 4,377,204 | | 3/1983 | Johansson | 165/166 |
| 4,556,106 | * | 12/1985 | Evans | 165/166 |
| 4,635,715 | | 1/1987 | Anderson | 165/167 |
| 4,905,758 | * | 3/1990 | Mathur et al. | 165/167 |
| 4,995,455 | * | 2/1991 | Mathur | 165/166 |
| 5,178,212 | * | 1/1993 | Nakamura | 165/166 |
| 5,727,620 | * | 3/1998 | Schaufele et al. | 165/167 |
| 5,887,650 | * | 3/1999 | Yang | 165/166 |
| 5,988,268 | * | 11/1999 | Usami et al. | 165/166 |

* cited by examiner

*Primary Examiner*—Ira S. Lazarus
*Assistant Examiner*—Terrell McKinnon
(74) *Attorney, Agent, or Firm*—Sheldon & Mak; Denton L. Anderson

(57) ABSTRACT

A combination of a plurality of heat exchange plates and sealing gaskets therefor, for use in a heat exchanger arrangement, each heat exchange plate having first and second sides, an edge, and a groove formed in the upper side thereof, extending along and spaced from the edge, and each sealing gasket having an elongate main portion, for seating in the groove of a first heat exchange plate, and for sealing between the first heat exchange plate and a second of the heat exchange plates when the second heat exchange plate is retained in compressive association therewith; and a plurality of plate gripping portions located in spaced arrangement along the length of the main portion, formed integrally therewith, and extending transversely away therefrom, for gripping predetermined portions of the plate so as to attach the gasket thereto, wherein the plate gripping portions are formed so as to provide to an assembler a visual indication as to whether the plate gripping portions and the plate are properly fastened together, at each predetermined portion of the plate.

24 Claims, 12 Drawing Sheets

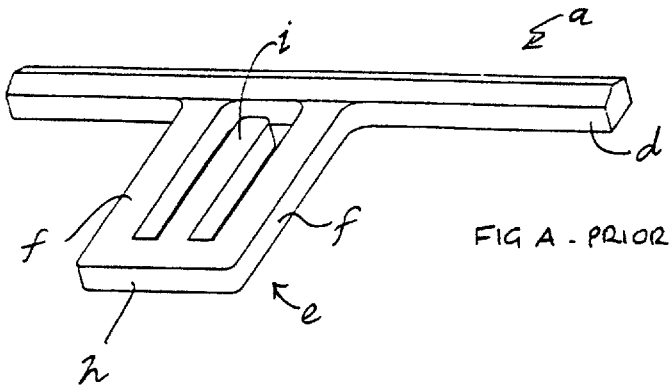
FIG A - PRIOR ART
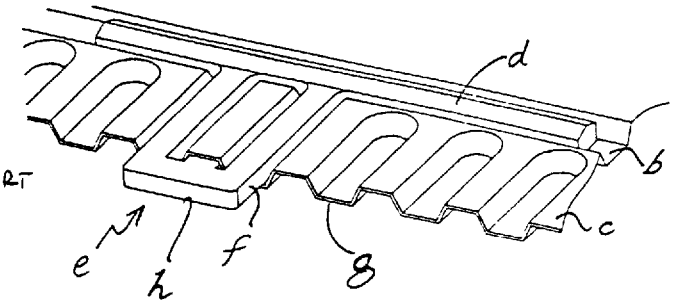
FIG B - PRIOR ART
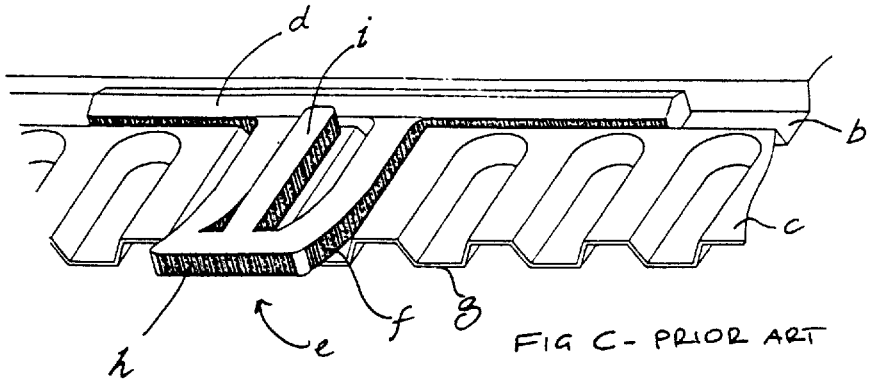
FIG C - PRIOR ART
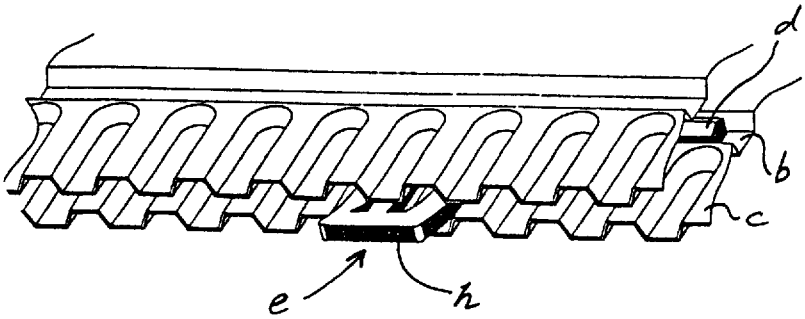
FIG D - PRIOR ART

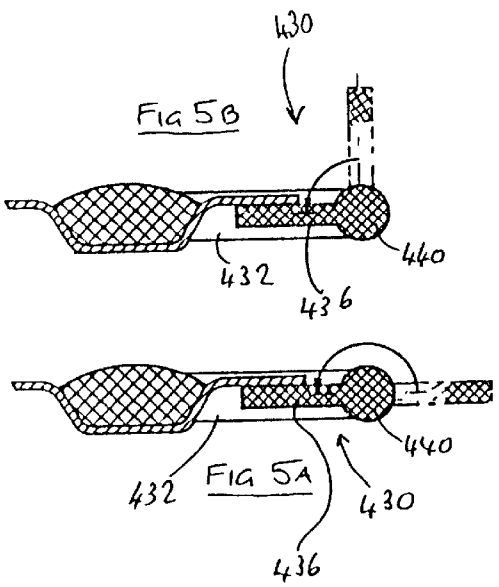
FIG 5B
FIG 5A
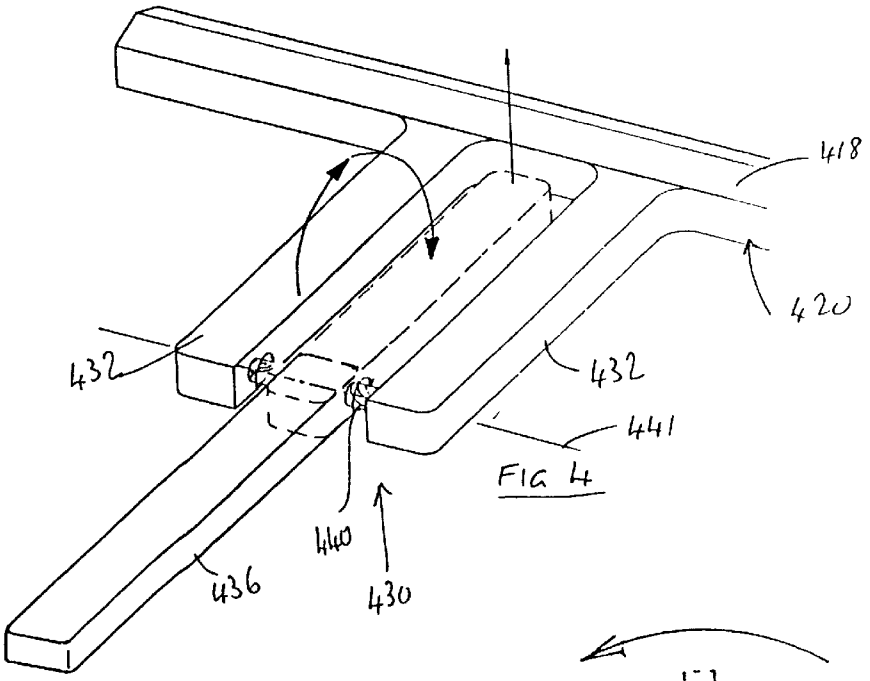
FIG 4
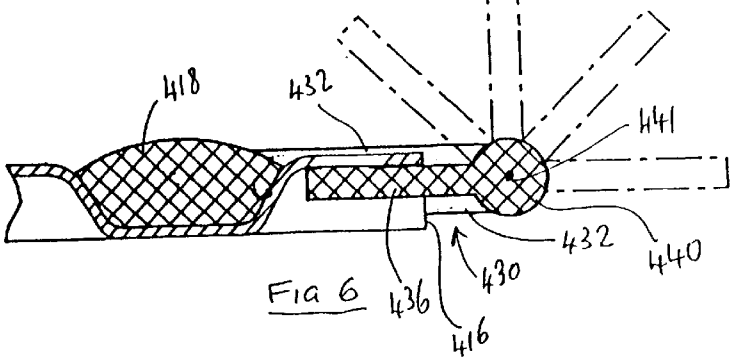
FIG 6

FIG 10A
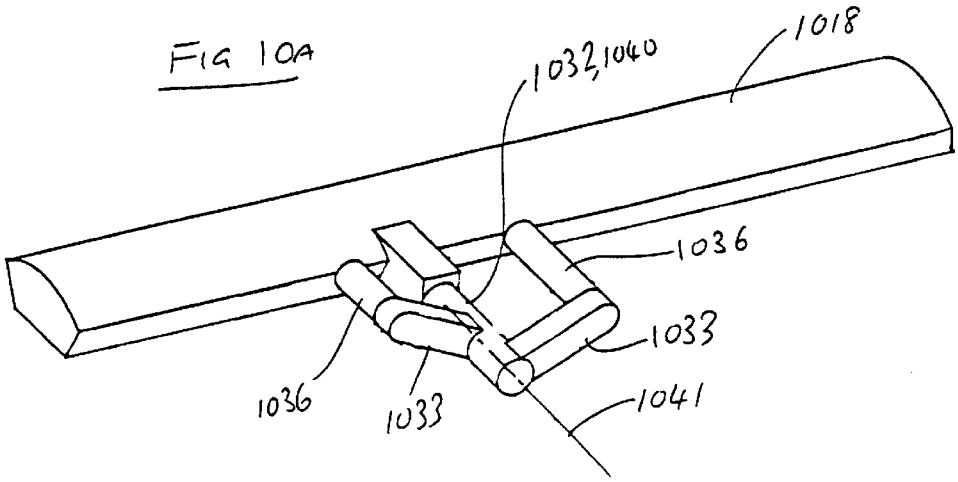
FIG 10B
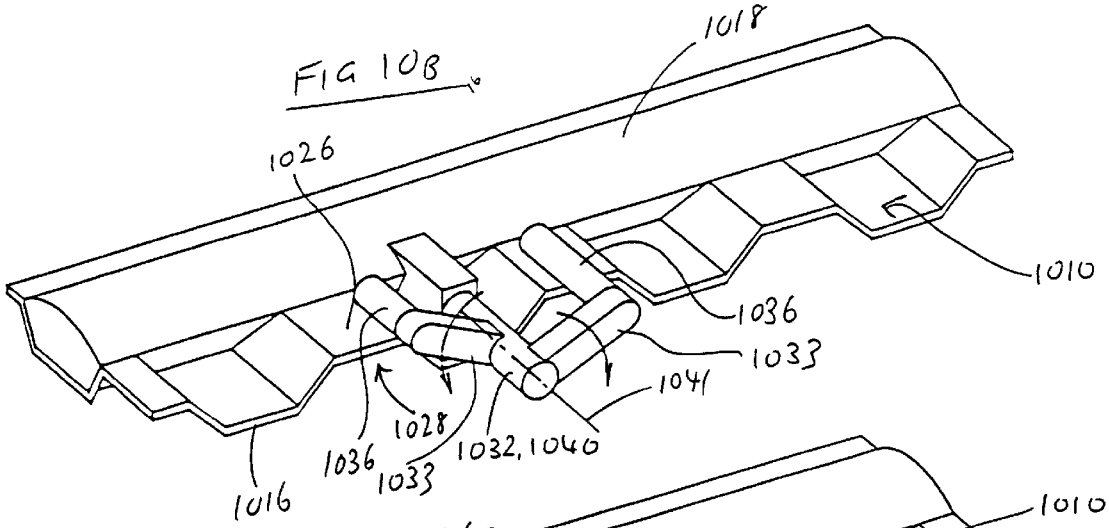
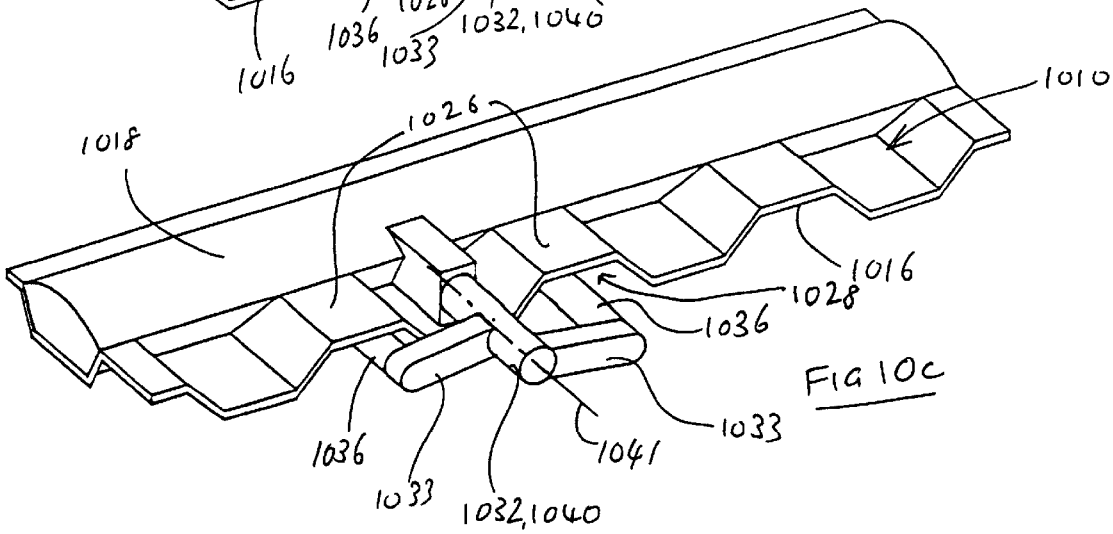
FIG 10C

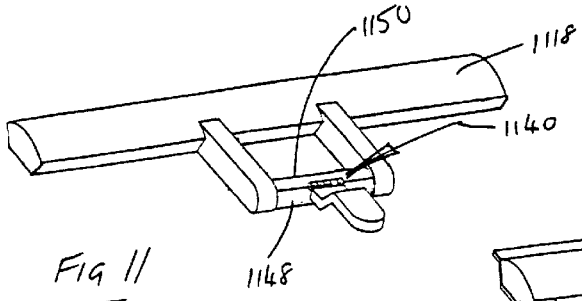
FIG 11
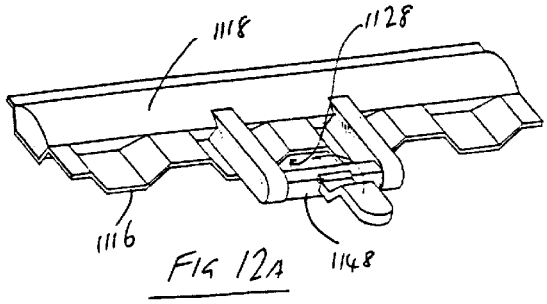
FIG 12A
FIG 12B
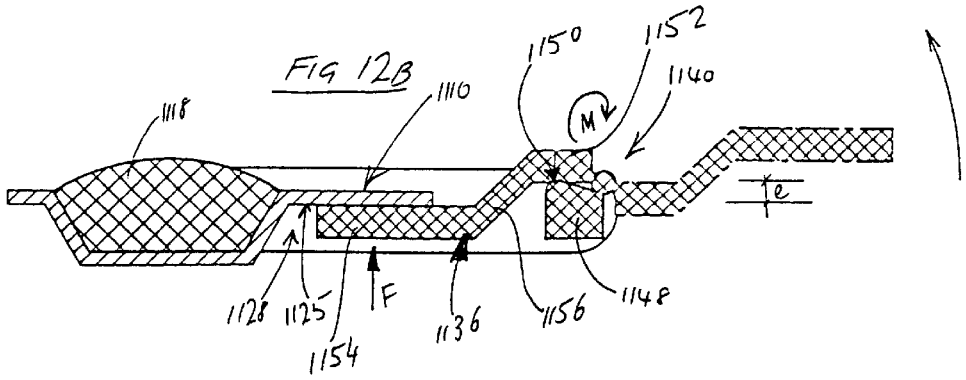
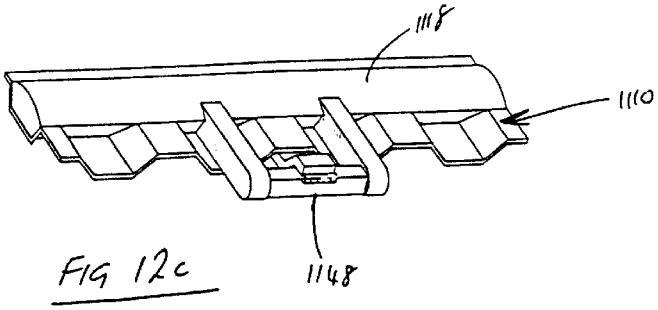
FIG 12C
FIG 13
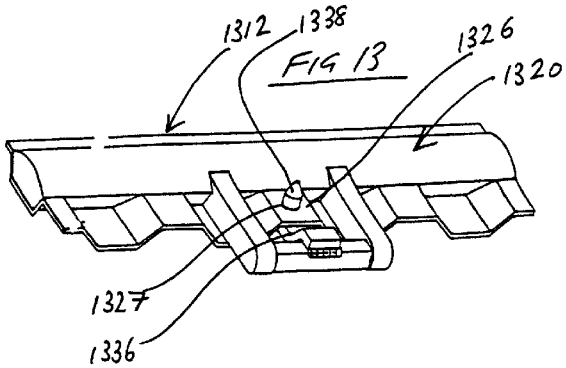

HEAT EXCHANGER PLATES AND SEALING GASKETS THEREFOR

FIELD OF THE INVENTION

The present invention relates to flat plate heat exchangers generally, and in particular to sealing gaskets therefor.

BACKGROUND OF THE INVENTION

It is well known in the art to construct flat plate heat exchangers, in which there is provided a plurality of plates arranged adjacent to each other and forming between them sealed passages for two mutually heat exchanging fluids. Flow passages are provided between the plates by virtue of transverse fluid ports formed therein, and by a rubber gasket located between each pair of facing plate surfaces. The gasket is generally of elongate, continuous form, and is arranged for seating in a preformed groove provided along the edge of each plate. The stack is assembled manually, by sliding each plate onto one or more elongate supports, so that the groove extends generally upwards, thereafter, a gasket is placed in the groove. Subsequently, an entire stack of plates and gaskets has been assembled on the supports, it is tightened together, thereby compression the gaskets between the plates so as to seal the spaces between the plates against leakage.

It is of particular importance to ensure that the gaskets are correctly positioned prior to the stack being tightened. Otherwise, the stack may not be properly sealed, leading to leakage. In the event that this happens, it is, of course, necessary to locate the improperly positioned gasket, and to partially dismantle the stack so as to align the gasket properly prior to tightening the stack once more.

Various efforts have been made to facilitate easier and more accurate placement and retention of gaskets prior to tightening.

U.S. Pat. No. 4,377,204, entitled "Plate Heat Exchanger," describes a plate heat exchanger arrangement in which the plate is formed with a plurality of holes between the gasket seating groove, and the plate edge, and wherein each gasket are provided with a plurality of tabs extending laterally outward from the main gasket portion, and wherein each tab has formed thereon a protrusion which is arranged for insertion into an adjacent hole. The protrusion is provided facing generally downwards, out of the view of a person assembling the gasket and the plate, so as to extend towards the surface of the plate in which the groove is formed, and must be pushed through the hole - away from the in order for the gasket to become properly fastened to the plate. Moreover, if the protrusions are not pushed through properly, then the gasket will not lay properly, and the extra thickness of a non-inserted protrusion may cause a slight misalignment of the gasket relative to the stack, causing an imperfect seal, and the problems caused thereby.

In an attempt to overcome this problem, U.S. Pat. No. 4,635,715, entitled "Gasket Arrangement for a Plate Heat Exchanger," teaches a gasket for placement into the gasket seating groove of a plate, and which has, on the side of the gasket closest to the plate edge, a plurality of spaced apart plate retention portions, which are arranged at a distance from each other.

This prior art gasket is illustrated in FIGS. A, B, C and D, herewith, and is denoted generally by the letter a. The main portion of gasket a, formed for seating in a groove b of a heat exchanger plate c, is indicated by the letter d. It will be appreciated that only small sections of both the gasket a and of the plate c are illustrated, and that, in the present drawings, and, indeed, through the present specification, they are intended to represent the entire gasket and plate, respectively.

FIG. A shows a section of the gasket a, and FIG. B shows proper placement thereof in groove b of heat exchanger plate c. Gasket a has a plurality of plate mounting portions e, of which a single one only, by way of illustrative example, is shown herein. Mounting portion e has one or more projections f, which are formed integrally with and perpendicular to the main gasket portion d, and thus also to the edge g of plate c. The projections f have integrally formed therewith a bridge portion h which is parallel to the main gasket portion d, and from which extend—at right angles thereto—one or more holding elements i. In the present example, a single holding element i is provided.

The holding elements i are parallel to and spaced longitudinally from the projections f and extend back towards the main gasket portion d, and therebetween, so that the projections f and holding elements i serve to effectively surround the plate edge g, such that the plate mounting portions serve to provide a retention force across the plate, and in the plane of the plate, thereby to reduce the chance of the gasket becoming detached from the plate.

A disadvantage, however, of the solution suggested in the above cited patent, is that it does not securely fasten a gasket to a plate, and, due to the relative flexibility of the gasket, does not provide sufficient purchase on the plate so as to prevent its dislodgment therefrom during assembly.

Furthermore, and referring now to FIG. C, it may happen during assembly, that the holding portion f thereof, instead of being fastened underneath the plate edge, instead remains on the top surface thereof. As now seen FIG. D, the assembling of a subsequent plate onto the improperly placed holding portion f, causes a misalignment in the assembled stack, thereby causing leakage therefrom. In practice, the misalignment is not normally discovered until use of the stack, which is a source of great inconvenience, as the system has to be properly emptied and disassembled, and, furthermore, as it is difficult to determine the location of the improperly placed holding portion, and it is required to disassemble much or all of the stack in order to determine its location.

SUMMARY OF THE INVENTION

It is an aim of the present invention to provide a gasket for use with a plate heat exchanger arrangement, in which each gasket has formed thereon a plurality of gripping elements for applying a positive gripping force transversely to the heat exchanger plate, thereby to positively retain the gasket in a desired position on the plate prior to tightening of a stack.

A further aim of the invention is to provide a gasket for use with a plate heat exchanger arrangement, in which each gasket has formed thereon a plurality of gripping elements for gripping an associated heat exchanger plate, and wherein, in the event that the gripping element is not properly positioned during assembly, there is provided a visual indication as to the location thereof, thereby facilitating easy correction of the problem prior to use of the assembled plate stack.

There is thus provided, in accordance with a preferred embodiment of the invention, a combination of a plurality of heat exchange plates and sealing gaskets therefor, for use in a heat exchanger arrangement, each heat exchange plate having first and second sides, an edge, and a groove formed in the upper side thereof, extending along and spaced from the edge, and each sealing gasket having an elongate main portion, for seating in the groove of a first heat exchange plate, and for sealing between the first heat exchange plate and a second of the heat exchange plates when the second heat exchange plate is retained in compressive association therewith; and a plurality of plate gripping portions located in spaced arrangement along the length of the main portion, formed integrally therewith, and extending transversely away therefrom, for gripping predetermined portions of the plate so as to attach the gasket thereto, wherein the plate gripping portions are formed so as to provide to an assembler a visual indication as to whether the plate gripping portions and the plate are properly fastened together, at each predetermined portion of the plate.

Further in accordance with a preferred embodiment of the present invention, each heat exchange plate has formed therein a plurality of openings extending between the first and second sides, and each plate gripping portion includes:

one or more connector portions associated with the first side of the plate and extending transversely across the plate edge so as to define a bridge portion thereat;

a holding tab connected to the one or more bridge portions, and extending generally inwards, transversely across the edge, in association with the second side of the plate; and a locking element formed on the holding tab and facing the second side of the plate, and operative, when the main gasket portion is seated in the groove, to be in registration with one of the openings, wherein the locking element is arranged for mating engagement with the opening, and a portion of the locking element is visible from the first side when in mating engagement with the opening.

Additionally in accordance with a preferred embodiment of the present invention, the one or more connector portions include two, spaced apart, connector portions so as not to cover the opening, there is provided a single bridge portion extending transversely between the connector portions, and the connector element is formed on the holding tab so as to be visible between the connector portions.

Further in accordance with a preferred embodiment of the present invention, each opening also opens out directly to the plate edge, thereby to facilitate a lateral movement of the connector element into an associated opening, generally in the plane of the plate, during engagement of the gripping portions with the plate.

Preferably, each gripping portion is operative to apply to the plate a gripping force in a direction transverse to the plate.

In accordance with an alternative embodiment of the invention, each gripping portion includes:

one or more connector portions associated with the first side of the plate and extending transversely from the main portion across the plate edge;

one or more flexible elongate gripping tabs; and hinge apparatus connecting the one or more tabs to the one or more connector portions, wherein each tab has an at rest position, prior to fastening of the gasket to the plate, whereat the tab projects generally away from the plate, and wherein, a rotation of the one or more tabs towards the first side of the plate and subsequent positioning of the one or more tabs in touching contact with the second side of the plate, causes the one or more tabs to be urged into gripping contact with the second side of the plate, thereby also to exert a generally equal and opposite force on the one or more connector portions, thereby urging the one or more connector portions into gripping contact with the first side of the plate.

Additionally in accordance with a preferred embodiment of the present invention, each tab has a locking element which, when each tab is in gripping engagement with the second side of the plate, is oriented so as to face the second side of the plate, and the plate has formed therealong a plurality of mating portions for mating engagement with the locking element of each tab.

Further in accordance with a preferred embodiment of the present invention, the mating portions are openings, and the locking element is a protrusion arranged for mating engagement with one of the openings.

Additionally in accordance with a preferred embodiment of the present invention, the mating portions are recesses formed in the second side of the plate, and the locking element is a tooth portion arranged for mating engagement with one of the recesses.

Further in accordance with a preferred embodiment of the present invention, the sealing gasket is formed of a single portion of a rubber-like material, the one or more tabs are connected to the one or more connector portions so as to form a joint thereat, and the hinge apparatus includes a natural hinge formed by a rotation of the one or more tabs relative to the one or more connector portions, about the joint.

Additionally in accordance with a preferred embodiment of the present invention, the hinge apparatus defines a hinge axis at a predetermined position relative to the plane of the plate, and each gripping portion further defines a raised bridging portion about which the one or more tabs must be flexed in order to insert it between the hinge apparatus and the plate so as to bring the one or more tabs into touching contact with the second side of the plate, so as to cause the one or more tabs to be urged into the gripping contact with the second side of the plate.

Further in accordance with a preferred embodiment of the present invention, the hinge apparatus defines a hinge axis generally parallel to the gasket main portion, and the one or more flexible elongate gripping tabs extend generally perpendicular thereto.

Additionally in accordance with a preferred embodiment of the present invention, the hinge apparatus defines a hinge axis generally perpendicular to the gasket main portion, and is constituted by the one or more connector portions, the one or more flexible elongate gripping tabs extend parallel to the one or more connector portions, and has an intermediate joining element connected to the one or more connector portions, extending generally perpendicular thereto.

Further in accordance with a preferred embodiment of the present invention, the one or more connector portions are constituted by a pair of elongate connector portions spaced apart along the gasket main portion, and there is provided a single elongate gripping tab mounted for insertion between the pair of elongate connector portions.

Additionally in accordance with a preferred embodiment of the present invention, the one or more connector portions are constituted by a single elongate connector portion, and there is provided a pair of elongate gripping tabs mounted to either side of the single elongate connector portion.

Further in accordance with a preferred embodiment of the present invention, each connector portion defines a free end which extends beyond the plate edge and defines a mounting portion thereat, there is provided a single elongate gripping tab mounted in the fork by the hinge apparatus so as to at least partially overlap the elongate connector portion when in gripping engagement with the second side of the plate.

In accordance with yet a further embodiment of the invention, there is provided a sealing gasket for use in a heat exchanger arrangement having a plurality of heat exchange plates, each plate having first and second sides, an edge, and a groove formed in the first side thereof, extending along and spaced from the edge.

In this embodiment of the invention, each sealing gasket includes:

an elongate main portion, for seating in the groove, and for sealing between the first heat exchange plate an a second of the heat exchange plates when the second heat exchange plate is retained in compressive association therewith;

one or more connector portions engaging, on the first side, a predetermined portion of the plate, formed integrally with the main portion and extending transversely therefrom across the edge of the plate, so as to define a free end; and one or more flexible gripping tabs connected via hinge apparatus to the free end of the one or more connector portions, the hinge apparatus being operative to permit folding of the one or more flexible tabs about an axis which is perpendicular to the one or more connector portions, so as to engage, on its second side, the predetermined portion of the plate, such that the predetermined portion of the plate is enclosed therebetween.

Additionally in accordance with the present embodiment of the invention, the hinge apparatus is operative to urge the one or more flexible tabs towards the one or more connector portions, such that, in the absence of the plate, the one or more flexible tabs and the one or more connector portions would be pressed together in mutual registration, and wherein, when mounted about the plate, the one or more flexible tabs and the one or more connector portions cooperate so as to grip the predetermined portion of the plate therebetween.

More particularly, the hinge apparatus and the free end of the one or more connector portions define therebetween an opening, and prior to mounting of the gasket onto the plate, the one or more tabs is in an at rest position, whereat the tab projects generally away from the plate; the one or more tabs being rotatable towards the first side of the plate, and insertable through the opening, thereby to be urged by the hinge apparatus into gripping contact with the second side of the plate.

Further in accordance with a preferred embodiment of the present invention, each elongate connector portion has a rear portion connected to the main gasket portion; a relatively raised main stem portion defining the free end; and a generally diagonal, intermediate portion, formed integrally with the rear portion and the stem portion and connecting therebetween.

Preferably, each flexible gripping tab is configured to be folded beneath the relatively raised main stem portion, so as to be in generally coplanar registration with the rear portion, thus as each rear portion is in generally coplanar registration with the main portion, also in generally coplanar registration with the main portion.

According to yet a further aspect of the invention, there is provided a heat exchanger plate having defined edge topography which includes an elongate groove extending parallel to the plate edge for seating a main gasket portion;

one or more channels formed transversely to the elongate groove and communicating therewith, extending towards the plate edge, for supporting the rear portion of each of the above-mentioned connector portions;

a raised portion, located between each channel and the edge, for supporting a single main stem portion of each of the above-mentioned connector portions; and an intermediate portion, joining between the channel and the raised portion, for supporting a single intermediate portion of each of the above-mentioned connector portions, wherein the raised portion defines therebeneath a hollow, in parallel registration with the raised portion, configured for receiving therein a flexible gripping tab.

BRIEF DESCRIPTION OF THE DRAWINGS

The present invention will be more fully understood and appreciated form the following detailed description, taken in conjunction with the drawings, in which:

FIGS. A–D are schematic illustrations of a PRIOR ART gasket, showing use thereof;

FIG. 4 is a schematic illustration of a portion of a gasket having resilient gripping portions for gripping the edge of a flat heat exchanger plate in accordance with a third embodiment of the present invention, in an at rest position, prior to assembly with a plate;

FIGS. 5A and 5B are cross-sectional views of the resilient gripping portion seen in FIG. 4, wherein a resilient holding element thereof is seen to be formed in a range of different possible positions, which, inter alia, serve to determine the gripping force applied thereby;

FIG. 6 is a schematic cross-sectional view of the gasket and a gripping portion thereof, fully mounted on the plate;

FIGS. 10A, 10B and 10C show a gasket which is generally similar to that of FIGS. 8A–8C, but wherein the resilient holding elements are connected thereto for rotation about an axis perpendicular to the main gasket portion;

FIG. 11 is a perspective view of a portion of a gasket having hinged, resilient gripping portions for gripping the edge of a flat heat exchanger plate in accordance with a fourth embodiment of the present invention, in an at rest position, prior to assembly with a plate;

FIG. 12A is a perspective view of the gasket of FIG. 11 in position on a flat plate, prior to attachment therebetween;

FIG. 12B is a cross-sectional view of the gasket and plate of FIG. 12A, taken along line B—B therein;

FIG. 12C is a perspective view of the gasket of FIG. 11 in position on a flat plate, after full mounting thereon of the gasket;

FIG. 13 is a view similar to FIG. 12C, but wherein the gasket employs, in combination, resilient portions for gripping and becoming matingly engaged with the edge of a flat heat exchanger plate;

DETAILED DESCRIPTION OF THE INVENTION

Figure 2A:
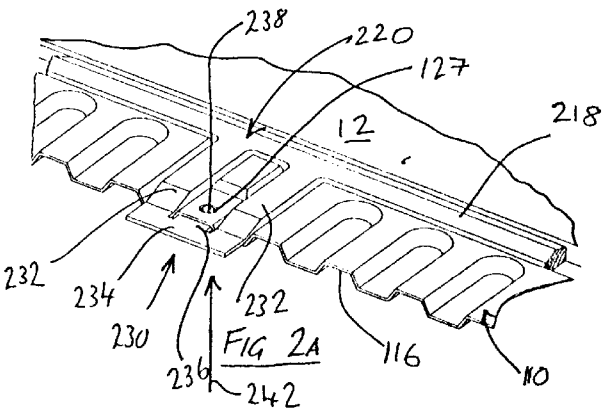
FIGS. 2A and 2B are schematic illustrations of a portion of a gasket and flat plate attachment arrangement, constructed in accordance with a first embodiment of the present invention.

The present invention seeks to provide, in combination, sealing gaskets for use with a plurality of flat plate heat exchange plates for arrangement in a stack, thereby providing a flat heat exchange stack assembly which is more easily assemblable, is less prone to leakage, and in which gaskets not properly positioned are more easily noticeable prior to use.

In the description that follows, various embodiments incorporating the principles of the invention are described. All of the embodiments have basic components in common, however, including a heat exchanger plate and portions thereof, and a gasket and portions thereof. For purposes of brevity and ease of understanding, these portions are generally described the first time that they are introduced only, and typically are not specifically described again, except as may be required for understanding of a particular embodiment. These portions are, however, normally denoted in the description with a one or two digit prefix, indicative of the drawing in which they are illustrated or, if a single embodiment is described in conjunction with more than one drawing, the prefix indicates the first drawing in which they are illustrated.

Figure 2B:
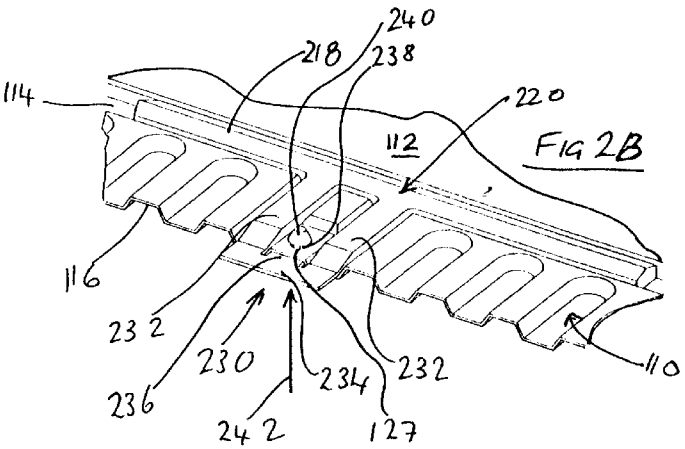
Figure 1:
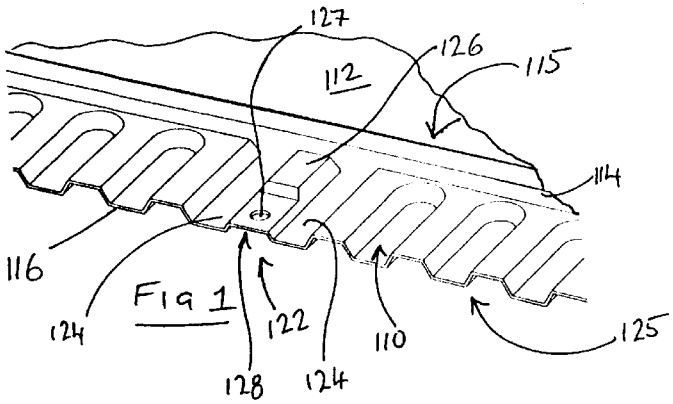
FIG. 1 is an edge portion of a flat plate for use in a heat exchanger, having an opening formed therein for use with gaskets formed in accordance with any of the embodiments of FIGS. 2A and 2B.

Referring now initially to FIG. 1, there is seen an edge portion 110 of a flat heat exchanger plate 112, whose topography is such that it can accommodate either of the gaskets shown and described below in conjunction with FIGS. 2A and 2B. In particular, and referring now also to FIGS. 2A and 2B, the heat exchanger plate 112 has an elongate, continuous groove 114, formed in a first side 115 thereof, parallel to the edge 116 of the plate, for seating the main portion 218 of a gasket 220 (FIGS. 2A and 2B). The plate also has formed therein a gasket mounting portion, referenced generally 122, which, in the present embodiment, is provided by a pair of channels 124 which extend at right angles from groove 114 to plate edge 116. Between the channels 124 and extending parallel thereto is a generally elongate, intervening ridge portion 126, which defines a on a second, underside 125 of the plate, a corresponding hollow or recessed portion 128. Ridge portion 126 also has an opening 127 formed therein.

Referring now particularly to FIGS. 2A and 2B, gasket 220 has a plate gripping portion, referenced generally 230, which provides for improved attachment of the gasket to the plate. Plate gripping portion 230 has a pair of elongate connector portions 232, which are formed integrally with and project perpendicularly from main gasket portion 218, and are thus oriented perpendicular to plate edge 116, when the main gasket portion 218 is seated in groove 114.

Connector portions 232 are joined to each other by an integral bridge portion 234 which is parallel to the main gasket portion 218, and from which extends—at right angles thereto—a holding tab 236. A connector stud 238, or the equivalent thereof, is formed onto holding tab 236. Holding tab 236 is configured for sliding into hollow 128, beneath ridge portion 126 of gasket mounting portion 122, such that, when main gasket portion 118 is properly seated in groove 114, and plate gripping portion 230 is fully engaged with gasket mounting portion 122, stud 238 is brought into registration with opening 127.

As seen in the drawings, stud 238 may take any suitable form, and may be, by way of example, a simple, generally cylindrical protrusion, as seen in FIG. 2A. Alternatively, however, it may have a conical widened end portion, as seen at 240 in FIG. 2B. As the entire gasket is made of a rubber-like material, the end portion 240 can be easily passed through opening 127, so as to lock the gasket in place.

Attachment of the gasket to the plate is thus completed by pressing on the back or underside of holding tab 236, as indicated by arrow 242, thereby to push stud 238 through opening 127 from behind, so as to be clearly visible when protruding therethrough. It will thus be appreciated that, in accordance with the present embodiment, due to the fact that the stud is pushed through from behind, in clear view of a person attaching the gasket to the plate, it is much easier to ensure that the gasket is mounted correctly.

Figure 3:
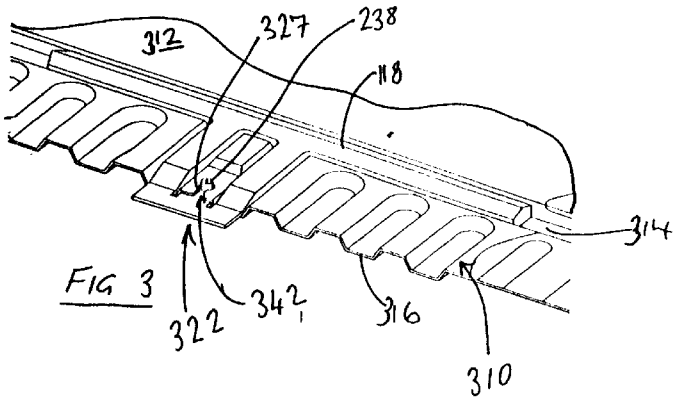
FIG. 3 is a schematic illustration of a portion of a gasket and flat plate attachment arrangement, constructed in accordance with a second embodiment of the present invention.

Referring now briefly to FIG. 3, it is seen that gasket mounting portion 322 may alternatively be formed such that, rather than a simple hole, plate opening 327 is formed so as to have a widened, generally funnel shaped opening 342 to edge 316, so as to enable stud 238 to be inserted simultaneously with the mating of connector portions 232 and holding tab 236 with edge portion 310 of plate 312.

Referring now to FIGS. 4–7B, gasket 420 has a plurality of plate gripping portions 430, each of which has a pair of elongate connector portions 432 which are formed integrally with and extend away from main gasket portion 418, and across plate edge 416 (FIGS. 5–7B). Elongate connector portions 432 are also seen to be spaced longitudinally apart along the gasket main portion 418. A single gripping tab 436 is disposed between connector portions 432, and are supported thereat by means of an integrally formed hinge 440, defining a hinge axis 441 parallel to plate edge 416.

In the present embodiment, the entire gasket 420 and all the various portions of the gripping portions 430 are preferably formed of a single piece of molded, rubber-like material. Accordingly, gripping tab 436 is formed so as to have an initial, at rest orientation which, in order to bring it into engagement with the plate, requires a relative rotation about hinge 440, thereby generating an elastic, rotational force, in the direction opposite to that of the rotation of the gripping tab 436. In an alternative embodiment, hinge 440 may be a separately formed rod like element, but also having additional resilient means (not shown) so as to provide a desired gripping force.

Referring now to FIGS. 5A–6, it is seen that main gasket portion 418 is formed so as to be seated in groove 414 of plate 412, and that after initial placement of the gasket on the plate, the gripping tab 436 has an initial, at rest orientation which is angled generally away from the plate, and from gasket main portion 418. The initial disposition of tab 436 is preferably in the range 90°–180° relative to the respective planes of plate 412 and connector portions 432, as seen in FIGS. 5A and 5B, thereby to ensure that when assembling a plate stack, gripping tab 436 of a non-properly fastened gasket is easily visible.

As indicated by arrow 442 (FIGS. 4 and 6), a rotational force is applied to gripping tab 436 so as to bring it from its at rest position, shown in FIG. 4 in solid lines, to a position of full gripping engagement with the underside or second side 425 of plate 412, shown in solid lines in FIGS. 5A, 58 and 6. The force required to rotate gripping tab 436 about a hinge axis 441, results in a gripping force transverse to the plate 412, as indicated by arrow 444 in FIG. 4, thereby causing an equal and opposite force to be applied to plate 412 by connector portions 432. It will be appreciated that the gripping force is thus a function of the rotational resistance provided by hinge 440, which, in turn is a function of the material properties, the cross-sectional area of the hinge, and the angle through which the gripping tab 436 must be rotated.

Figure 7A:
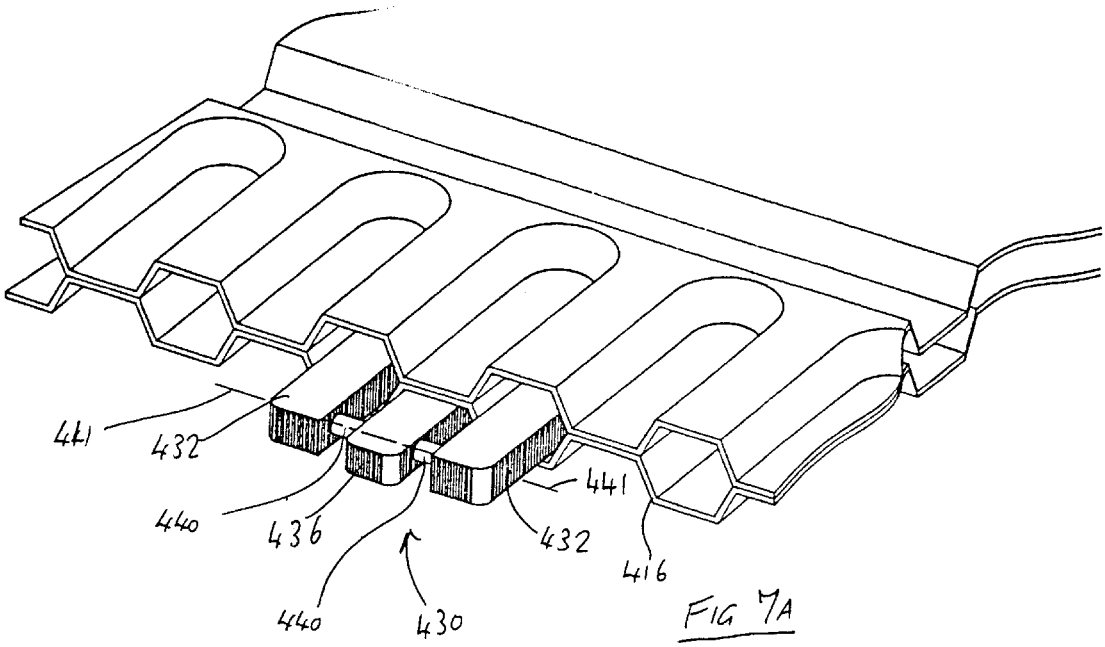
FIGS. 7A and 7B show the gasket of FIGS. 4–6 mounted in a plate stack in properly and improperly mounted positions, respectively.
Figure 7B:
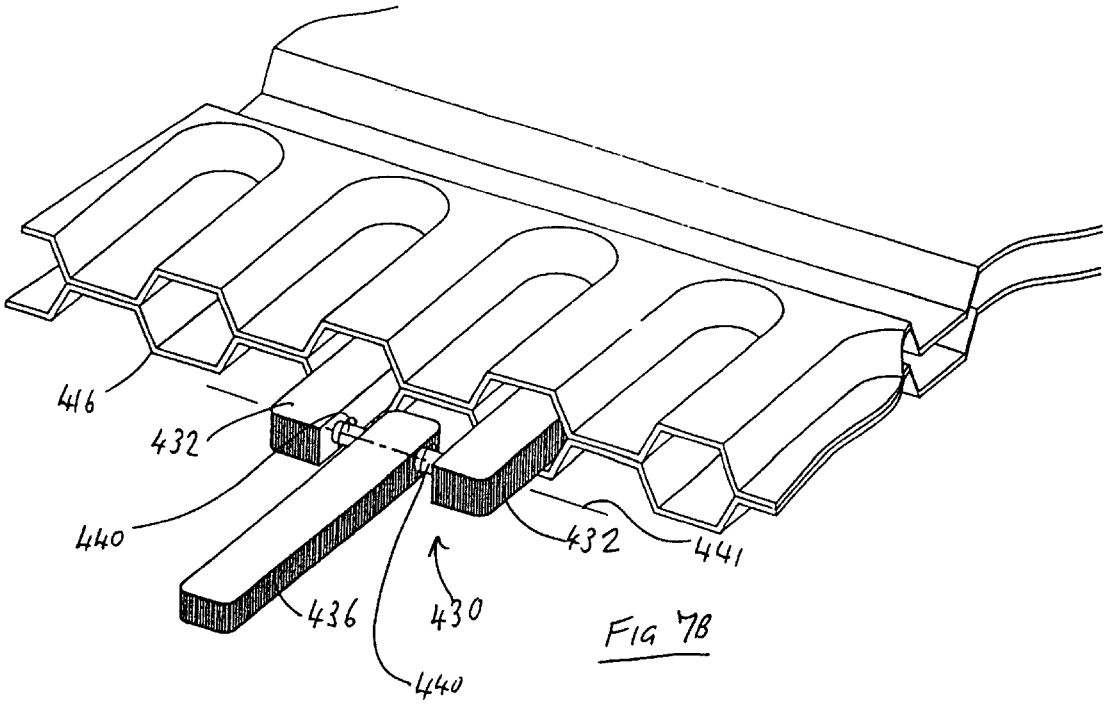

As is clear from FIG. 6, in the present embodiment of the invention, tab 436 must be inserted in the space between hinge 440 and the plate edge 416, in order to enable ultimate insertion into hollow 428. The proper positioning of gasket 420, including full mating and gripping engagement of plate gripping portion 430 with plate 412, is seen in FIG. 7A. FIG. 7B, on the other hand, clearly shows an improper or incomplete mounting of the gasket 420, indicated by gripping tab 436 standing out in flag like fashion.

Figure 8A:
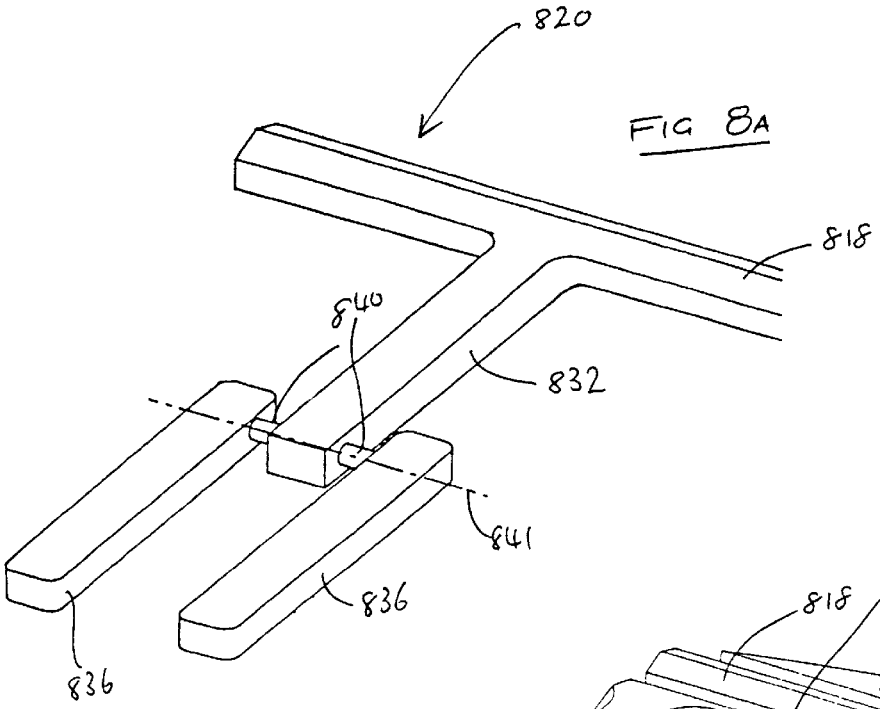
FIGS. 8A, 8B and 8C show a gasket which is generally similar to that of FIGS. 4–7B, but wherein the resilient gripping portions thereof each have a single projection and a pair of resilient holding elements connected thereto, wherein the gasket is seen in an at rest, non-mounted position, an at rest position after initial mounting thereof, and in a fully mounted, gripping position, respectively.
Figure 8B:
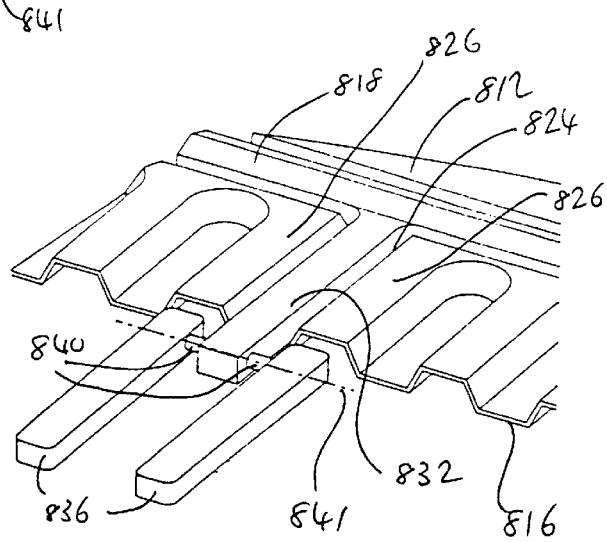
Figure 8C:
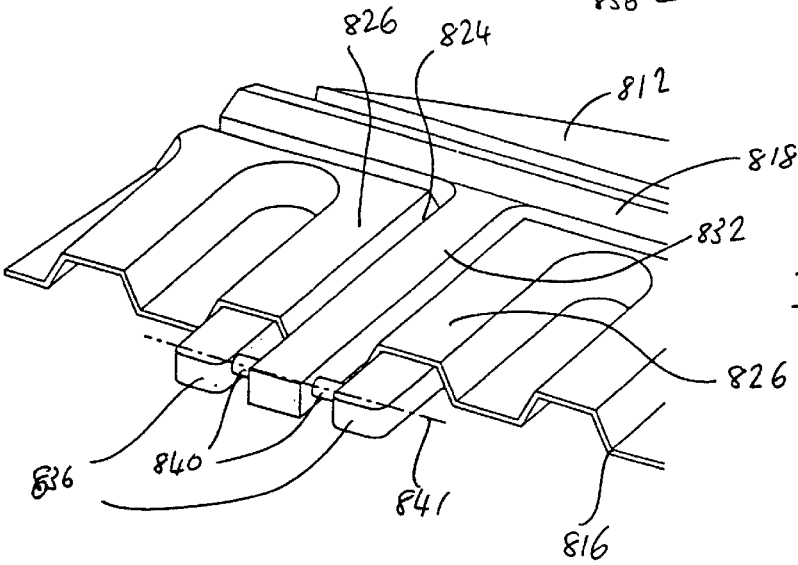

Referring now briefly to FIGS. 8A, 8B and 8C, there is shown an embodiment of the invention which is generally similar to that shown and described above in conjunction with FIGS. 4–7B, but wherein the gasket 820 has a single elongate connector portion 832 to which a pair of gripping tabs 836 are fastened, parallel thereto, via a pair of hinge elements 840, defining a hinge axis 841. In order to accommodate the illustrated gasket 820, plate 812 is provided with a single channel 824, which is bounded by a pair of ridge portions 826, defining therebeneath hollows 828. Mounting of the gasket 820 is generally as described above in relation to gasket 420, and is thus not described again herein.

Figure 9A:
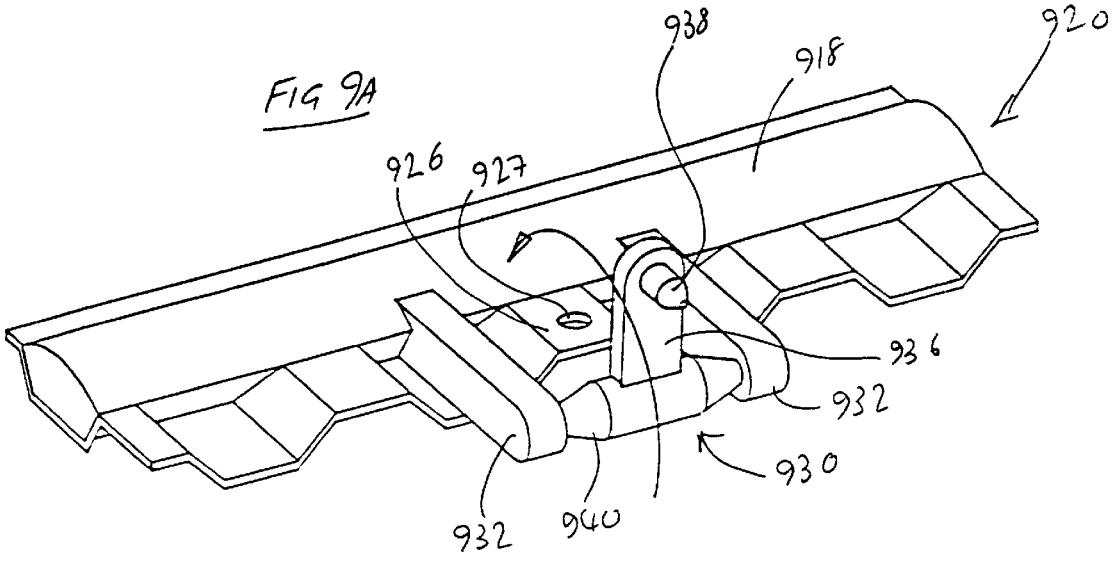
FIGS. 9A and 9B show a gasket employing, in combination, resilient portions for gripping and becoming matingly engaged with the edge of a flat heat exchanger plate, seen prior to and after full mounting, respectively.
Figure 9B:
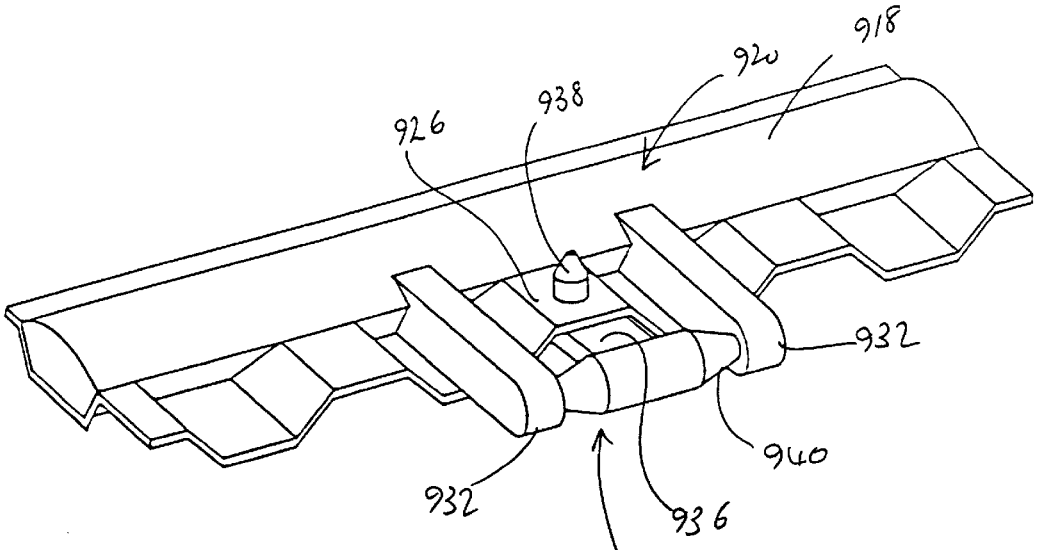

FIGS. 9A and 9B show both a gasket 920 and a plate 912 which, while being generally similar to those described above in conjunction with FIGS. 4–7B, is also provided with an additional locking facility, by means of an opening 927 formed in ridge portion 926 of plate edge portion 910, and a locking protrusion 938 arranged for mating engagement with opening 927, once the remainder of plate gripping portion 930 had been brought into complete mating engagement with plate edge portion 910.

Referring now to FIGS. 10A–10C, there is seen a gasket and plate combination in which the plate edge portion 1010 is substantially similar to that shown and described above in conjunction with FIGS. 8B and 8C, but wherein there is provided a single connector portion 1032, which is arranged at right angles to the gasket main portion 1018, and which also constitutes a hinge 1040, such that a hinge axis 1041 is also generally perpendicular to both the gasket main portion 1018, but also to the plate edge 1016.

Holding tabs 1036 are formed parallel to axis 1041, so as to be insertable beneath ridge portions 1026, as seen in FIGS. 10B and 10C, and are connected to connector portion 1032 via an intermediate joining element 1033, extending at right angles between connector portion 1032 and gripping tabs 1036.

Referring now to FIGS. 11–12C, there is seen yet a further gasket and plate combination, but wherein the gripping force is not necessarily provided by means of an integral hinge. In the present embodiment, the hinge apparatus 1140 may either be an integral, natural hinge, or a separate hinge element with little or no rotational resistance, there also being provided a raised bridging portion 1148. Bridging portion 1148, as seen most clearly in FIG. 12B, defines an edge 1150 which, as seen, is located above the second side 1125 of plate edge portion 1110, by an amount e, thereby requiring gripping tab 1136 to be bent therearound, prior to insertion into hollow 1128. This causes a moment of resistance M to be applied by bridging portion 1148 to tab 1136, resulting in a transverse gripping force F being applied by tab 1136 to the underside or second side 1125 of plate edge portion 1110.

It will be appreciated that the magnitude of the gripping force is determined by the flexibility of the tab 1136, the magnitude of the height difference e, and the optional provision of flexure characteristics to hinge 1140.

The gripping tab 1136 of the present embodiment is seen to have a generally stepped configuration, having a rear portion 1152 connected to hinge 1140, a front, free end portion 1154, for engaging the plate second surface 1125, and a diagonal, intermediate portion 1156, connecting between rear portion 1152 and front portion 1154. It will be appreciated, however, that this is by way of example only, and that a gripping tab having a non-stepped configuration may also be used.

Referring briefly now to FIG. 13, there is shown, in combination, a plate 1312 and a gasket 1320, which are similar to plate 1112 and gasket 1120 of FIGS. 11–12C, but wherein ridge portion 1326 is provided with an opening 1327 for receiving in mating engagement a locking protrusion 1338 attached to gripping tab 1336.

A feature common to the plate gripping portions of all the gaskets shown and described above in conjunction with FIGS. 2A–13, is that the flexible tabs thereof have all been spaced longitudinally from the elongate connector portions extending from the gasket main portion.

Figure 14A:
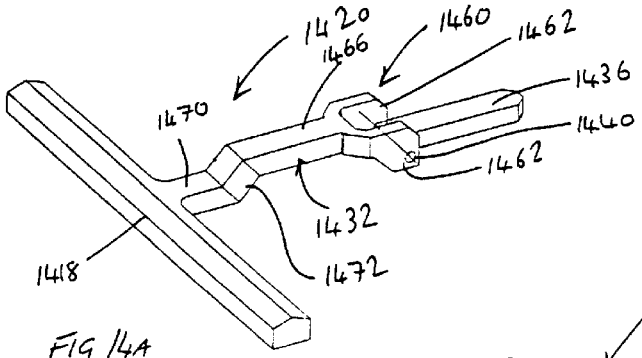
FIGS. 14A and 14B are perspective views of a portion of a gasket having resilient gripping portions for gripping the edge of a flat heat exchanger plate in accordance with a fifth embodiment of the present invention, employing a single resilient gripping element supported on a single projection, seen in an at rest position, prior to assembly with a plate.
Figure 14B:
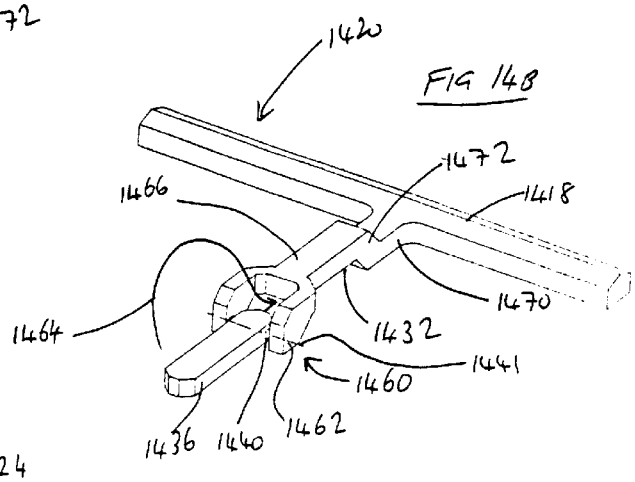
Figure 15:
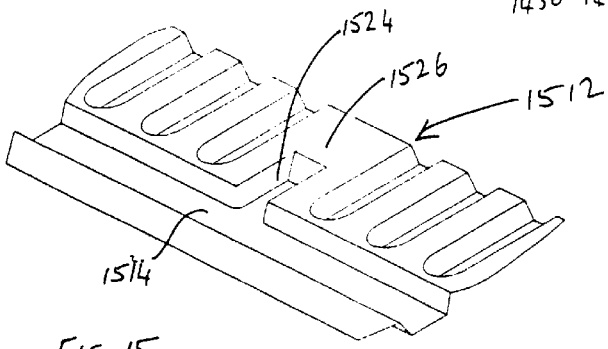
FIG. 15 is a portion of a flat heat exchange plate for use with the gasket of FIGS. 14A and 14B.

In the embodiments of the invention shown and described hereinbelow in conjunction with FIGS. 14A–21B, however, a feature common to all of them is that the gripping tabs thereof at least partially overlap the one or more elongate connector portions to which they are connected. Referring now initially to FIGS. 14A and 14B, there is seen a portion of a gasket 1420, which is configured for use in combination with a flat plate 1512 (FIG. 15); the combination being illustrated in a fully, properly mounted orientation in FIG. 16. Plate gripping portions 1430 of gasket 1420 each have a single elongate connector portion 1432 which extends transversely outwards from main portion 1418, and terminates, in the present embodiment, in a forked mounting portion, referenced generally 1460, so as to allow full registration of the single gripping tab 1436 therebeneath, so as to firmly grasp the plate edge portion therebetween.

Figure 16:
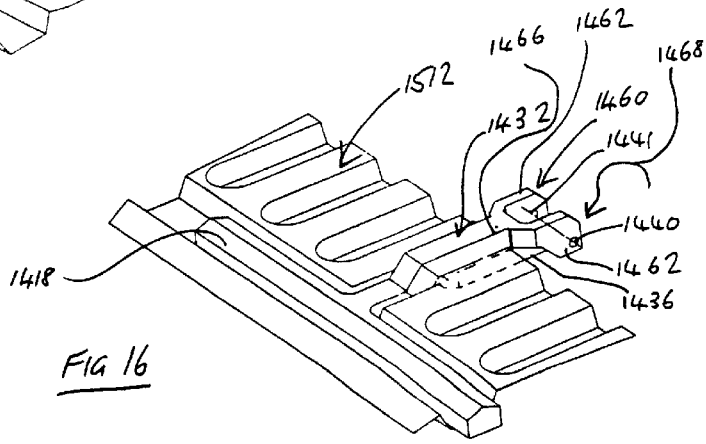
FIG. 16 is a perspective view of the gasket of FIGS. 14A and 14B mounted onto the flat plate of FIG. 15.

Mounting portion 1460 splits into a pair of mounting elements 1462, between which is supported a single gripping tab 1436, via hinge elements 1440, in much the same manner as exemplified by the arrangement seen in FIG. 4. Accordingly, in order to properly fasten gasket 1420 to plate 1512, it is necessary to rotate tab 1436 in a generally upward direction (as per the illustrated orientation) about hinge axis 1441, as shown by arrow 1464 (FIG. 14B), and to insert it between the axis 1441 and main stem 1466 of connector portion 1432, as shown in FIG. 16 by arrow 1468.

In the present embodiment, the connector portion 1432 and gripping tab 1436 overlap, and so both the plate edge topography and the plate gripping portion 1430 are formed so as to accommodate the gripping tab 1436 in generally the same plane as gasket main portion 1418. In order to do this, connector portion has a generally stepped configuration, having a rear portion 1470 connected to main portion 1418, and a diagonal, intermediate portion 1472 from which main stem 1466 extends.

Similarly, channel 1524 communicating with groove 1514 extends only part of the way to plate edge 1516, being interrupted by ridge portion 1526, supporting main stem 1466. It will thus be appreciated that, when the plate and gasket combination is fully assembled, the gripping tab 1436 and main stem 1466 of each plate gripping portion 1430, serve to apply a vice-like gripping force about the plate edge 1512, perpendicular thereto.

Figure 17:
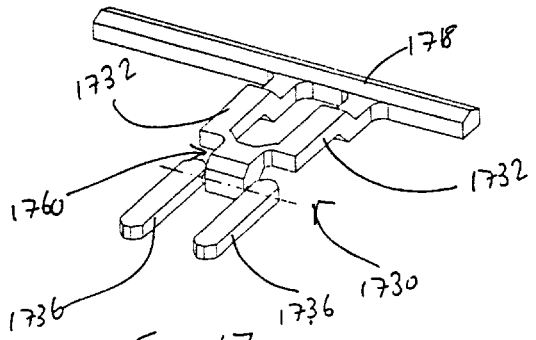
FIG. 17 is a perspective view of a portion of a gasket having a pair of resilient gripping elements supported on a pair of projections, constructed and operative in accordance with a sixth embodiment of the present invention, in an at rest position.
Figure 18:
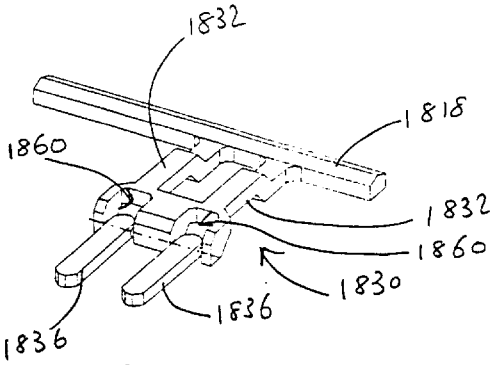
FIG. 18 is a perspective view of a portion of a gasket having a pair of resilient gripping elements, also supported on a pair of projections, constructed and operative in accordance with a seventh embodiment of the present invention, in an at rest position.

FIGS. 17 and 18 illustrate gaskets having plate gripping portions that are generally similar in function to those described above in conjunction with FIGS. 14A–16.

In FIG. 17, the illustrated plate gripping portion 1730 has a pair of elongate connector portions 1732, which terminate in a mounting portion 1760 which mounts a pair of gripping tabs 1736, in a manner similar to that in which tabs 836 are mounted to connector portion 832, as shown and described hereinabove in conjunction with FIGS. 8A–8C.

In FIG. 18, however, the illustrated plate gripping portion 1830 has a pair of elongate connector portions 1832, which terminate in an integrally formed pair of forked mounting portions 1860, each of which mounts a single gripping tab 1836, in a manner similar to that in which tabs 1436 are mounted to forked mounting portion 1460, as shown and described hereinabove in conjunction with FIGS. 14A, 14B and 16.

Figure 19:
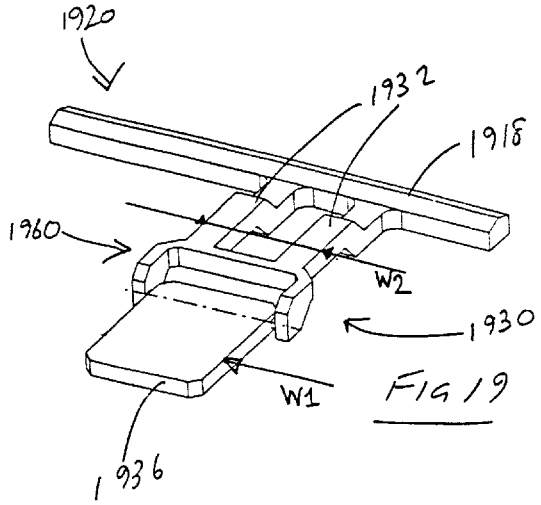
FIG. 19 is a perspective view of a portion of a gasket having a single resilient gripping element supported on a pair of projections, constructed and operative in accordance with a eighth embodiment of the present invention, in an at rest position.

FIG. 19 illustrates a gasket 1920 having a plate gripping portion 1930 in which a pair of spaced apart elongate connector portions 1932 terminate in a single forked mounting portion 1960, in which a single gripping tab 1936, whose overall width W1 is approximately equal to the corresponding exterior dimension W2 of the pair of connector portions 1932. Accordingly, when plate gripping portion 1920 is in full gripping engagement with the plate edge (not shown), gripping tab 1936 is configured so as to completely overlap the pair of connector portions 1932, thereby providing a relatively increased gripping interface between plate and the gripping portion 1930.

Figure 20:
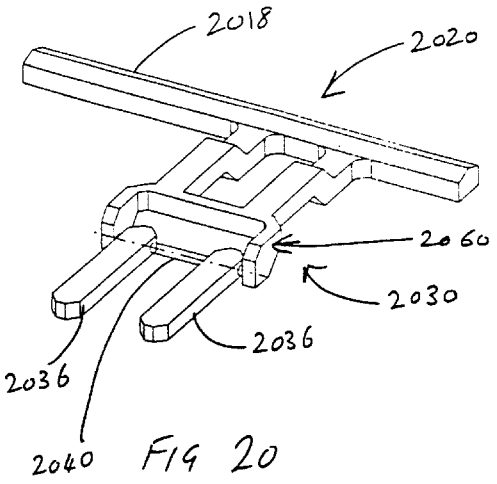
FIG. 20 is a perspective view of a portion of a gasket having a pair of resilient gripping elements supported on a pair of projections, constructed and operative in accordance with a ninth embodiment of the present invention, in an at rest position.

FIG. 20 illustrates a gasket 2020 having a plate gripping portion 2030 which is generally similar to that of FIG. 19, except that a pair of gripping tabs 2036 is mounted in forked mounting portion 2060, via a relatively elongated hinge element 2040, as shown.

Figure 21A:
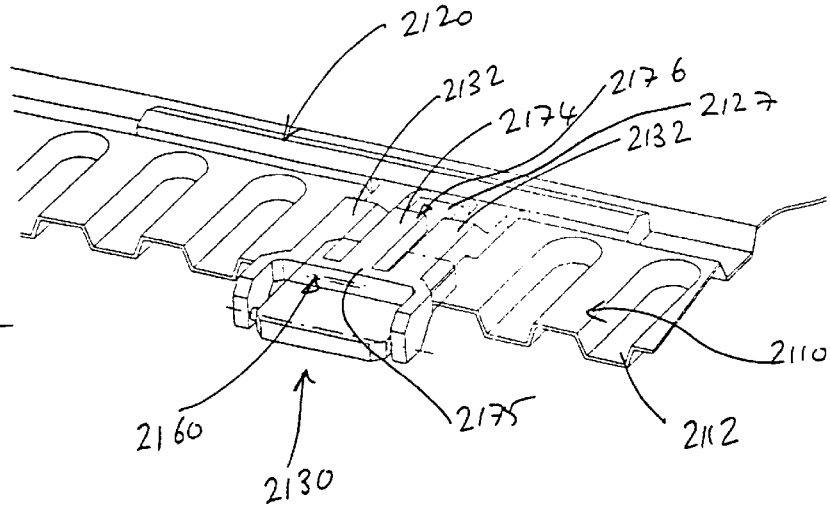
FIG. 21A is a perspective view of a portion of a gasket having a single resilient gripping element supported on a pair of projections, but also having an adjacent plate locator element, constructed and operative in accordance with a tenth embodiment of the present invention, in an position of full engagement with a plate.
Figure 21B:
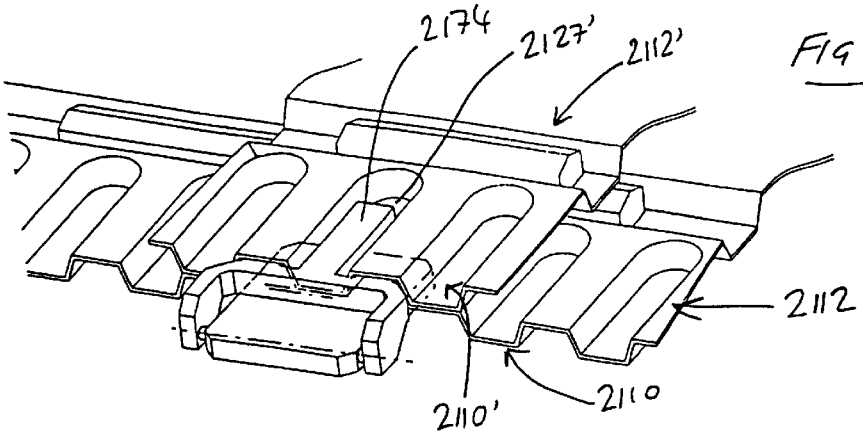
FIG. 21B is a perspective view similar to FIG. 21A, but illustrating the positioning of an additional plate in mating engagement with the plate locator element of the gasket.

Referring now to FIGS. 21A and 21B, there is seen a gasket 2120 having a mounting portion 2130 which is generally similar to that shown and described in conjunction with FIG. 19, except for the addition of an indexing member 2174. Indexing member 2174 is located between elongate connector portions 2132, and is attached at a rear end 2175 to mounting portion 2160, and has a front free end 2176.

When mounting portion 2130 is fully engaged with plate edge portion 2110, the indexing member 2174 extends over the ridge portion 2127.

As seen in FIG. 21B, when an additional plate 2112' is assembled in an adjacent position in the stack, its edge portion 2110' is inserted between indexing member 2174 and ridge portion 2127 of the lower plate edge portion 2110, thereby further securing the gasket 2120. As seen, however, in the present embodiment, in order to utilize the indexing tab 2174, the additional plate 2112' is inverted so that ridge portion 2127' thereof rests on ridge portion 2127 of the lower plate edge portion 2110.

Figure 22A:
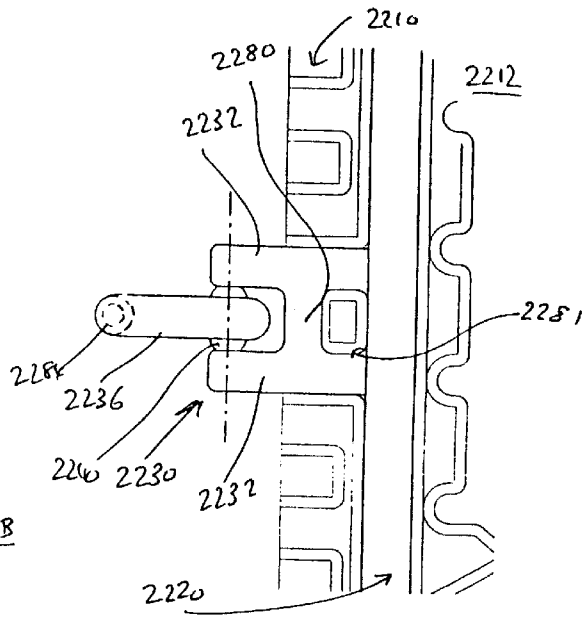
FIGS. 22A and 22B are plan views of a portion of a gasket having a single resilient gripping element supported on a pair of projections, constructed and operative in accordance with an eleventh embodiment of the present invention, in respective partially an fully mounted positions, respectively.
Figure 22B:
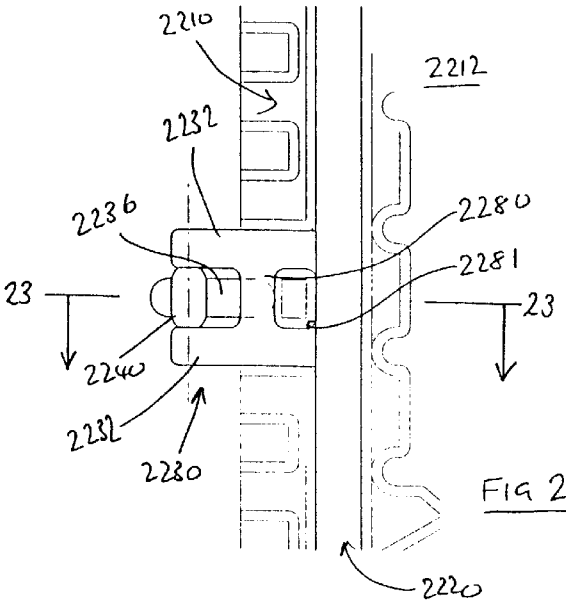
Figure 23:
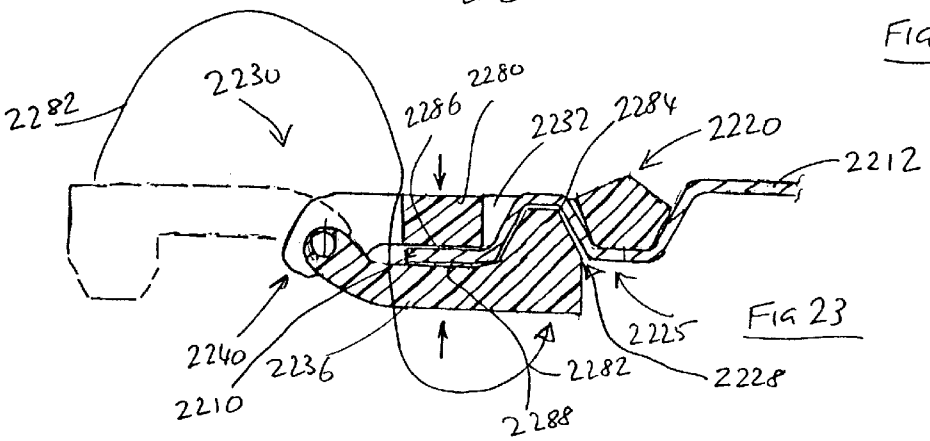
FIG. 23 is a cross-sectional view of the gasket and plate seen in FIG. 22B, taken along line 23—23 therein.

Referring now to FIGS. 22A–23, there is seen, in combination, a heat exchange plate 2212 and a gasket 2220 having plate gripping portions 2230. Each plate gripping portion 2230 has a pair of elongate connector portions 2232 extending at right angles from main gasket portion 2218. Connector portions 2232 are connected by a cross member 2280, so as to have a generally H-like shape, and thus leaving an opening 2281. A gripping tab 2236 is mounted to connector portions 2232 via a resilient hinge element 2240, and is adapted for insertion into gripping contact with second side 2225 of plate edge portion 2210, as indicated by arrow 2282 in FIG. 23. Gripping tab 2236 has a locking protrusion 2284, whose function is described below. It is also seen that cross member 2280 defines a generally flat, plate contact surface 2286, and gripping tab 2236 also defines a plate contact surface 2288, which are brought into registration with each other upon full engagement of the plate gripping portions 2230 with plate edge portions 2210, as seen in FIG. 23, thereby providing a vice-like contact therebetween.

Figure 24:
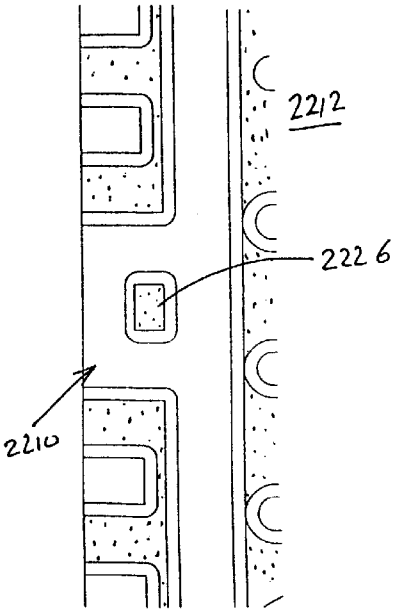
FIG. 24 is a plan view showing the topography of an edge portion of the plate seen in FIGS. 22A, 22B and 23.

Referring now also to FIG. 24, the topography of plate edge portion 2210 is formed so as to accommodate the locking protrusion 2284, by providing a ridge portion 2226. The ridge portion 2226 has a generally rectangular, truncated pyramid shape, so as to define a hollow 2228 therebeneath, in the second side 2225 of the plate 2212, thereby to enable mating engagement thereof with the locking protrusion 2284. Furthermore, the ridge portion 2226 and the opening 2281 are formed so as to also accommodate each other in a mating arrangement, thereby providing maximum purchase between.

It will be appreciated by persons skilled in the art that the scope of the present invention is not limited by what has been shown and described hereinabove. Rather the scope of the present invention is limited solely by the claims, which follow.

What is claimed is:

1. A sealing gasket for use in a heat exchanger arrangement having a plurality of heat exchange plates, each plate having first and second sides, an edge, and a groove formed in at least the first side thereof, extending along and spaced from the edge, wherein each said sealing gasket includes:

an elongate main portion, for seating in the groove, and for sealing between said first heat exchange plate and a second of said heat exchange plates when said second heat exchange plate is retained in compressive association therewith; and at least one plate gripping portion, which includes:

at least one connector portion engaging, on the first side, a predetermined portion of the plate, said at least one connector portion being formed integrally with said main portion and extending transversely therefrom across the edge of the plate, so as to define a free end; and at least one tab connected via hinge apparatus to said free end of said at least one connector portion, and arranged for folding with respect thereto so as to be brought into association with the second side of the predetermined portion of the plate.

2. A sealing gasket according to claim 1, wherein each said at least one tab has an initial, at rest position, having an angular inclination with respect to said at least one connector portion, and said hinge apparatus is operative to permit folding of said at least one tab from said at rest position to a position of engagement with the second side of the predetermined portion of the plate under a force related to a force under which said tab seeks to return to its at rest position.

3. A sealing gasket according to claim 1, wherein said hinge apparatus and said free end of said at least one connector portion define therebetween an opening, and wherein, said at least one said tab is rotatable towards the first side of the plate, and insertable through said opening, thereby to be urged by said hinge apparatus into association with the second side of the predetermined portion of the plate.

4. A sealing gasket according to claim 3, wherein said at least one connector portion is a pair of elongate connector portions spaced apart along said basket main portion so as to form an opening therebetween.

5. A sealing gasket according to claim 4, wherein said at least one tab is a single tab arranged to lie in registration with said opening between said pair of elongate connector portions.

6. A sealing gasket according to claim 5, wherein said sealing gasket also includes a bridging portion formed between said pair of elongate connector portions, and between said hinge apparatus and said main portion, and defining said opening between said pair of elongate connector portions, and wherein said bridging portion and said tab are formed so as to be in mutually compressive engagement when said tab is extended through said opening in a position of engagement with the second side of the predetermined portion of the plate, thereby to cause a transverse force to be applied thereto by the tab.

7. A sealing gasket according to claim 4, wherein said at least one tab is a single tab arranged to engage the second side of the plate in registration with said pair of elongate connector portions and said opening therebetween.

8. A sealing gasket according to claim 4, wherein said at least one tab is a pair of tabs arranged to engage the second side of the plate in registration with said pair of elongate connector portions.

9. A sealing gasket according to claim 1, wherein each said elongate connector portion includes:

a rear portion connected to said main gasket portion;

a relatively raise d main stem portion defining said free end; and an intermediate portion, formed integrally with said rear portion and said stem portion and connecting therebetween.

10. A sealing gasket according claim 9, wherein each said tab is configured to be folded beneath said relatively raised main stem portion.

11. A sealing gasket according to claim 10, wherein each said tab is configured to be folded beneath said relatively raised main stem portion, an d s o as to be in generally co planar registration with said rear portion.

12. A sealing gasket according to claim 11, wherein each said rear portion is in generally coplanar registration with said main portion, and each said tab, when folded beneath said relatively raised main stem portion, is also in generally coplanar registration with said main portion.

13. A sealing gasket according to claim 1, wherein said at least one connector portion includes a pair of connector portions, and said at least one plate gripping portion further includes a bridge portion connecting between said pair of connector portions in a direction generally parallel to said main portion.

14. A sealing gasket according to claim 13, wherein said bridge portion is laterally spaced from said main portion, so as to form an opening therebetween.

15. A sealing gasket according to claim 13, wherein said mating portions are recesses formed in the second side of said plate, and said locking element is a tooth portion arranged for mating engagement with one of said recesses.

16. A sealing gasket according to claim 1, wherein said at least one tab is formed so as to provide to a heat exchanger assembler a visual indication as to whether each said plate gripping portion is properly fastened to the plate, at each predetermined portion thereof.

17. A sealing gasket according to claim 16, wherein each heat exchange plate has formed therein a plurality of openings extending between the first and second sides thereof, and each said connector portion has a bridge portion formed at said free end thereof, wherein said tab is connected to said bridge portion;

wherein said tab has formed therewith a locking element facing the second side of the plate, operative, when said main gasket portion is seated in the groove, to be in registration with one of the plurality of openings;

and wherein said locking element is arranged for mating engagement with the opening, and a portion of said locking element is visible from the first side of the plate when in mating engagement with the opening.

18. A sealing gasket according to claim 17, wherein said at least one connector portion includes two, spaced apart, connector portions so as not to cover said opening, said bridge portion extends transversely between said connector portions, and said connector element is formed on said holding tab so as to be visible between said connector portions.

19. A sealing gasket according to claim 18, wherein each said opening also opens out directly to the plate edge, thereby to facilitate a lateral movement of said connector element into an associated opening, generally in the plane of the plate, during engagement of said gripping portions with said plate.

20. A sealing gasket according to claim 1, wherein the plate has formed there along a plurality of mating portions, and wherein each said tab has a locking element which, when each said tab is in a position of association with the second side of the plate, said locking element is in mating engagement with one of the mating portions.

21. A sealing gasket according to claim 20, wherein said mating portions are openings, and said locking element is a protrusion arranged for mating engagement with one of said openings.

22. A sealing gasket according to claim 1, formed of a single portion of a rubber-like material, wherein at least one tab is connected to said at least one connector portion so as to form a joint thereat, and wherein said hinge apparatus includes a natural hinge formed by a rotation of said at least one tab relative to said at least one connector portion, about said joint.

23. A sealing gasket according to claim 1, wherein said hinge apparatus defines a hinge axis generally parallel to said gasket main portion, and said at least one tab extends generally perpendicular thereto.

24. A sealing gasket according to claim 1, wherein said hinge apparatus defines a hinge axis generally perpendicular to said main portion, and lies along said at least one connector portion, said at least one flexible elongate tab extends parallel to said at least one connector portion, and has an intermediate joining element connected to said at least one connector portion, extending generally perpendicular thereto.

* * * * *